US005666944A

United States Patent [19]

Ferguson

[11] Patent Number: 5,666,944

[45] Date of Patent: Sep. 16, 1997

[54] WATER HEATING APPARATUS WITH PASSIVE FLUE GAS RECIRCULATION

[75] Inventor: Mark A. Ferguson, Watauga, Tex.

[73] Assignee: PVI Industries, Inc., Fort Worth, Tex.

[21] Appl. No.: 524,001

[22] Filed: Sep. 5, 1995

Related U.S. Application Data

[63] Continuation-in-part of Ser. No. 79,156, Jun. 17, 1993, abandoned.

[51] Int. Cl.[6] ..... F23C 9/06

[52] U.S. Cl. ..... 126/391; 126/360 R; 431/9; 431/115

[58] Field of Search ..... 431/9, 115, 116; 126/391, 360 R

[56] References Cited

U.S. PATENT DOCUMENTS

| | | | |
|---|---|---|---|
| 2,502,664 | 4/1950 | Nest | 431/265 |
| 3,097,686 | 7/1963 | Morrow | 431/115 |
| 4,465,024 | 8/1984 | Adams . | |
| 4,545,329 | 10/1985 | Adams . | |
| 4,926,765 | 5/1990 | Dreizler et al. | 431/115 |
| 5,129,818 | 7/1992 | Balsiger | 431/115 |

FOREIGN PATENT DOCUMENTS

| | | | |
|---|---|---|---|
| 04454413 | 9/1991 | European Pat. Off. | 431/115 |
| 2365186 | 7/1975 | Germany | 431/9 |

*Primary Examiner*—Carl D. Price
*Attorney, Agent, or Firm*—Charles D. Gunter, Jr.

[57] ABSTRACT

The invention relates to a water heating apparatus and method to passively recirculate flue gas in order to reduce $NO_x$ emissions formed during combustion. The apparatus uses a high efficiency burner, a submergible, pressurized, combustion chamber having multiple external heating surfaces, and a flue collector that collects and passively recirculates a portion of the flue gases back into the burner air intake while exhausting the rest. The multiple external heating surfaces are installed within a closed tank and are submerged in water under pressure during use.

4 Claims, 4 Drawing Sheets

WATER HEATING APPARATUS WITH PASSIVE FLUE GAS RECIRCULATION

CROSS REFERENCE TO RELATED APPLICATIONS

This application is a continuation-in-part of my earlier filed application, Ser. No. 08/079,156, filed Jun. 17, 1993, now abandoned, by the same inventor and entitled "Water Heating Apparatus With Passive Flue Gas Recirculation."

BACKGROUND OF THE INVENTION

1. Field of the Invention

The present invention relates to a water heating apparatus and method utilizing passive flue gas recirculation for reducing $NO_x$ emissions during heating.

2. Description of the Prior Art

Water heaters and boilers form nitrogen oxides during combustion. The high combustion temperatures typical of such devices fix some oxides of nitrogen. These combustion compounds are found in flue gases mainly as nitric oxide (NO), with lesser amounts of nitrogen dioxide ($NO_2$) and other oxides. The total amount of nitric oxide plus nitrogen dioxide in a flue gas effluent is referred to simply as nitrogen oxides, or $NO_x$.

Depending on the type of fuel, two types of nitrogen oxide reactions occur. In the first type of reaction, fuel bound $NO_x$ forms from nitrogen present in the fuel itself, for example, fuel oils. During combustion, nitrogen released from the fuel reacts rapidly with oxygen from the combustion air to form $NO_x$. These fuel bound reactions are not particularly temperature-dependent. In the second type of reaction, thermal $NO_x$ forms at high combustion temperatures. High combustion temperatures break down the nitrogen gas in air to atomic nitrogen. The atomic nitrogen subsequently reacts with oxygen to form thermal $NO_x$.

Nitrogen oxide emissions are air pollutants. Various state and federal agencies regulate the amount of $NO_x$ in vented gases, especially in heavily populated areas such as the Los Angeles Basin of California. Tightening state and federal regulations for emission requirements warrant the effort to find new ways to remove or prevent the formation of nitrogen oxides in combustion processes to avoid further harmful effects on the environment.

The type of fuel burned affects the type and amount of $NO_x$. If only natural gas is used, thermal $NO_x$ is formed exclusively, because natural gas does not contain any nitrogen containing compounds. The burning of fuel oils, on the other hand, forms both thermal and fuel bound $NO_x$. No. 6 oil, for example, contains large amounts of nitrogen and thus produces a large amount of fuel bound $NO_x$.

It is well known that cooling the combustion flame temperature decreases $NO_x$ production. The effect of flame temperature reduction decreases thermal $NO_x$ production with a lesser effect on decreasing fuel bound $NO_x$ production. Therefore, the flame temperature reduction by the recirculation of flue gas is most effective when burning natural gas.

Flue gas recirculation reduces $NO_x$ emissions from water heating systems by decreasing the amount of $NO_x$ formed. Typically, a duct connects a flue stack to a recirculation fan. Another duct couples the fan to the combustion air inlet of a burner or the combustion chamber. Since these systems directly feed the recirculated flue gas to the burner flame region where fuel is also being introduced, they often require the use of control devices to regulate the feed of recirculated flue gas for efficient and safe combustion.

U.S. Pat. No. 4,545,329, issued Oct. 8, 1985, and assigned to the assignee of the present invention, describes a unique submerged combustion chamber/forced draft burner water heater having improved efficiency characteristics. Optimizing $NO_x$ reduction in such water heating devices using submergible, pressurized combustion chambers and high turbulence power burners, presents problems not encountered in other conventional water heating systems. For example, such systems differ from other water heating systems by the amount of injected combustion air and by pressure drops at various locations in the system. The preferred fire tube apparatus described in U.S. Pat. No. 4,545,329 requires much higher air injection pressures to force combustion gases through the constricted, narrow fire tubes which help to increase efficiency of the unit. This results in shorter residence time for the flue gases in the fire tubes. Thus, greater recirculation rates are required for a fire tube type apparatus to obtain adequate $NO_x$ reduction.

To the best of Applicant's knowledge, prior attempts to use passive flue gas recirculation have not been successful in systems of the type presently under consideration. In this disclosure, the term "passive" refers to employing no additional active components, such as fans, impellers, blowers, control devices, and the like, other than the components that are already a part of the heating apparatus. These passive systems either do not work for a submergible, pressurized combustion device with a high turbulence power burner, often due to poor combustion, or the level of $NO_x$ emissions is too high for the present government regulations. For example, many power burners with air suction and high pressure delivery characteristics cannot use a passive recirculation system. These systems require a separate blower strictly for the purpose of inducing combustion products from the burner vent and forcing them into a combustion chamber where fuel is also being introduced. In the process, combustion air and recirculated flue gas incompletely mixes before introducing the fuel, thus leading to incomplete combustion.

Prior passive systems do not mix fresh air with the recirculated flue gas prior to combustion. These systems blow recirculated flue gas directly into the burner flame where it remains separated from combustion air.

The present invention has one object, to produce a passive flue gas recirculation system for a submerged combustion chamber/forced draft burner water heating device that reduces $NO_x$ levels, yet does not interfere with the efficiency of combustion.

Another object of the present invention is to produce a water heating device having a passive flue gas recirculation system which premixes flue gases and fresh air in a gas-mixing region of the burner prior to the introduction of fuel and the beginning of the combustion process.

Another object of the invention is to produce such a water heating device having $NO_x$ emissions below about 30 to 40 ppm and a heating efficiency of at least about 83%.

Another object of the present invention is to produce such a device which is relatively simple in design and economical to manufacture.

Another object of the present invention is to eliminate the complexity and failure modes associated with non-passive, or active $NO_x$ flue gas recirculation control systems.

SUMMARY OF THE INVENTION

The present invention provides a method and apparatus for the passive recirculation of flue gas within a water heating device of the type having a submerged combustion chamber located within a closed tank and having a high turbulence power burner for creating products of combustion within the submerged combustion chamber. Preferably, the submerged combustion chamber has multiple external heating surfaces that extend through openings in the closed tank so that all of the heating surfaces are submerged in water under pressure.

The water heating device also has a flue collector which includes a flue opening and an annular chamber. The flue collector is mounted to the tank exterior, with the flue opening communicating with the combustion chamber whereby a burner can be fitted within the flue opening to produce controlled combustion within the combustion chamber. The annular chamber surrounds the flue opening and the burner, yet remains separated therefrom. The annular chamber receives the exhaust products from the combustion chamber for exhaustion to the atmosphere. The annular chamber is also equipped with a flue gas recirculation outlet.

The flue gas recirculation outlet is passively connected by means of a conduit to a gas recirculation inlet located in an air intake region of the burner.

The air-fed, forced draft burner which is mounted onto the flue collector includes a burner housing, an air intake shroud and a fuel/air mixing passage leading up to a pressure plate. The burner housing contains a motor-driven impeller, which forces air and recirculated flue gas from the air intake shroud into the fuel/air mixing passage for complete mixing of the intake air, recirculated flue gas and fuel prior to passing through the pressure plate. An ignition means located on an opposite face of the pressure plate ignites the fuel/air mixture with the resulting flame passing out the burner nozzle into the submerged combustion chamber.

Additional objects, features and advantages will be apparent in the written description that follows.

DETAILED DESCRIPTION OF THE INVENTION

Figure 1:
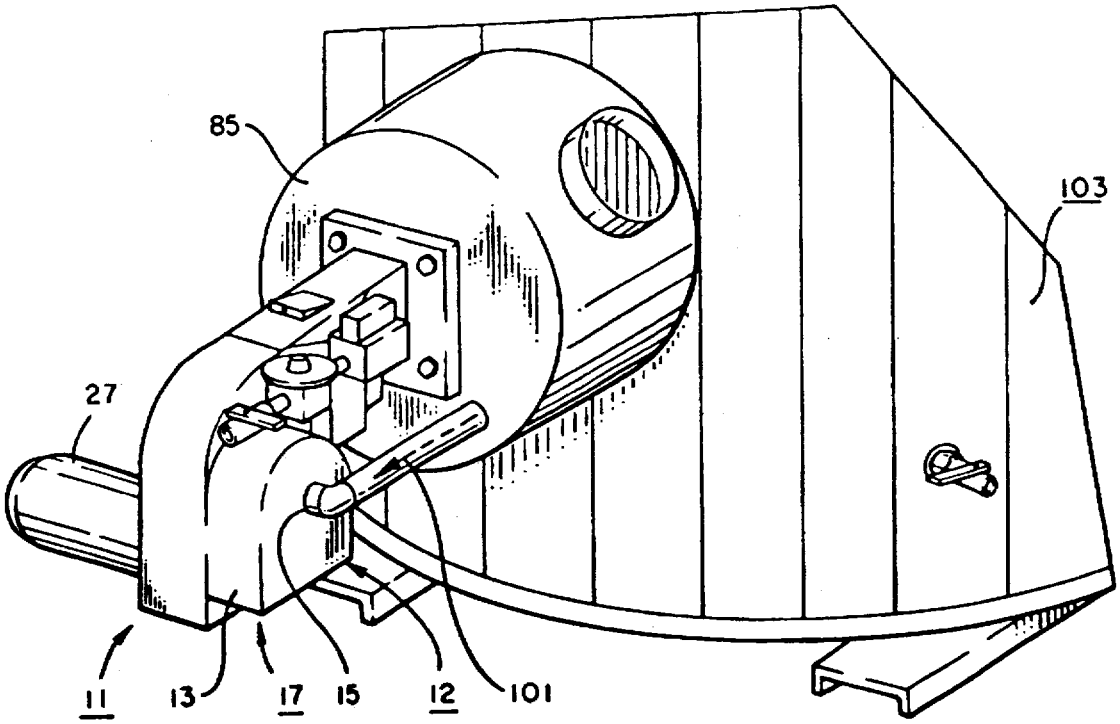
FIG. 1 is a view of a water heating apparatus of the invention.
Figure 3:
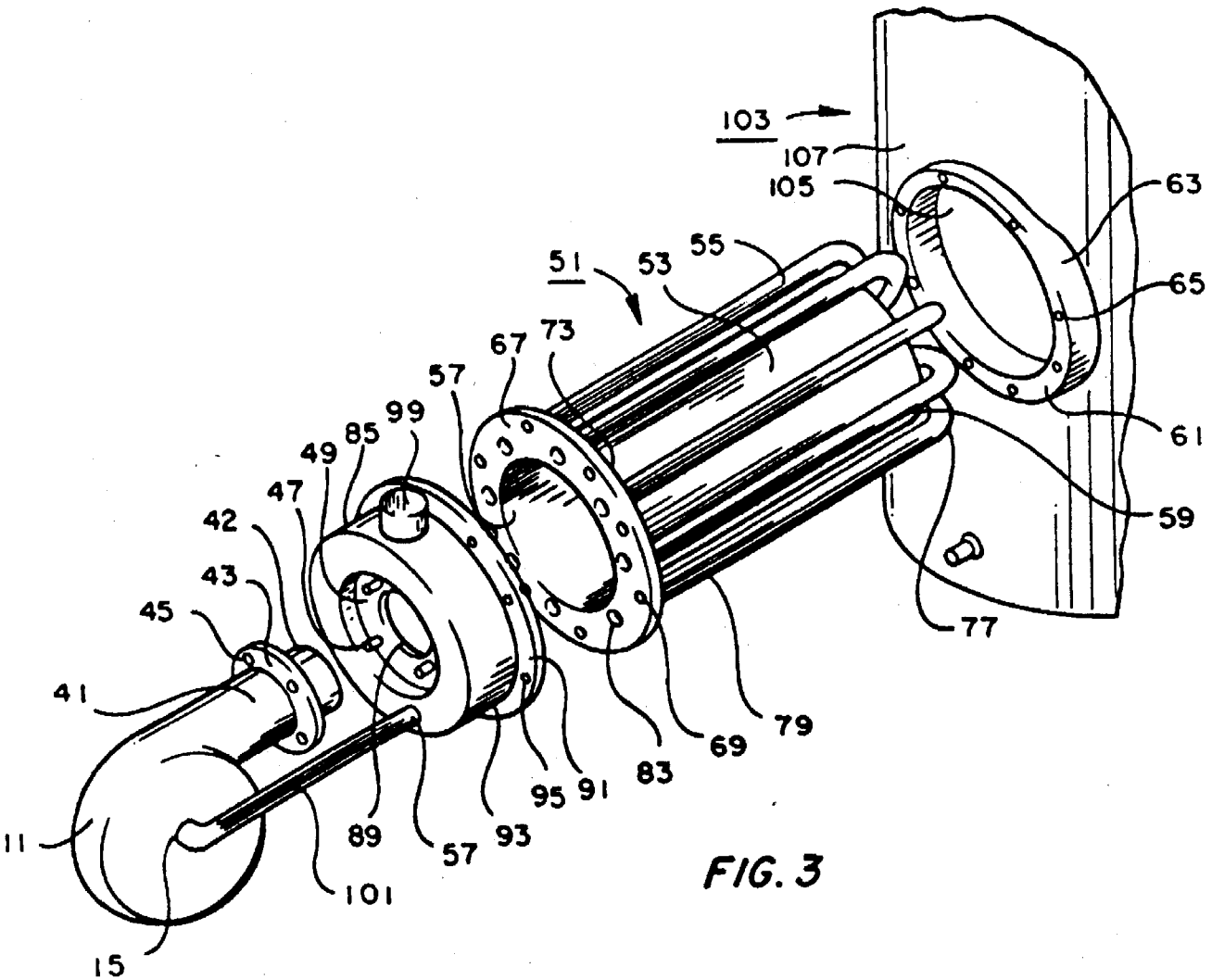
FIG. 3 is an exploded, perspective view of a water heating apparatus of the invention.
Figure 4:
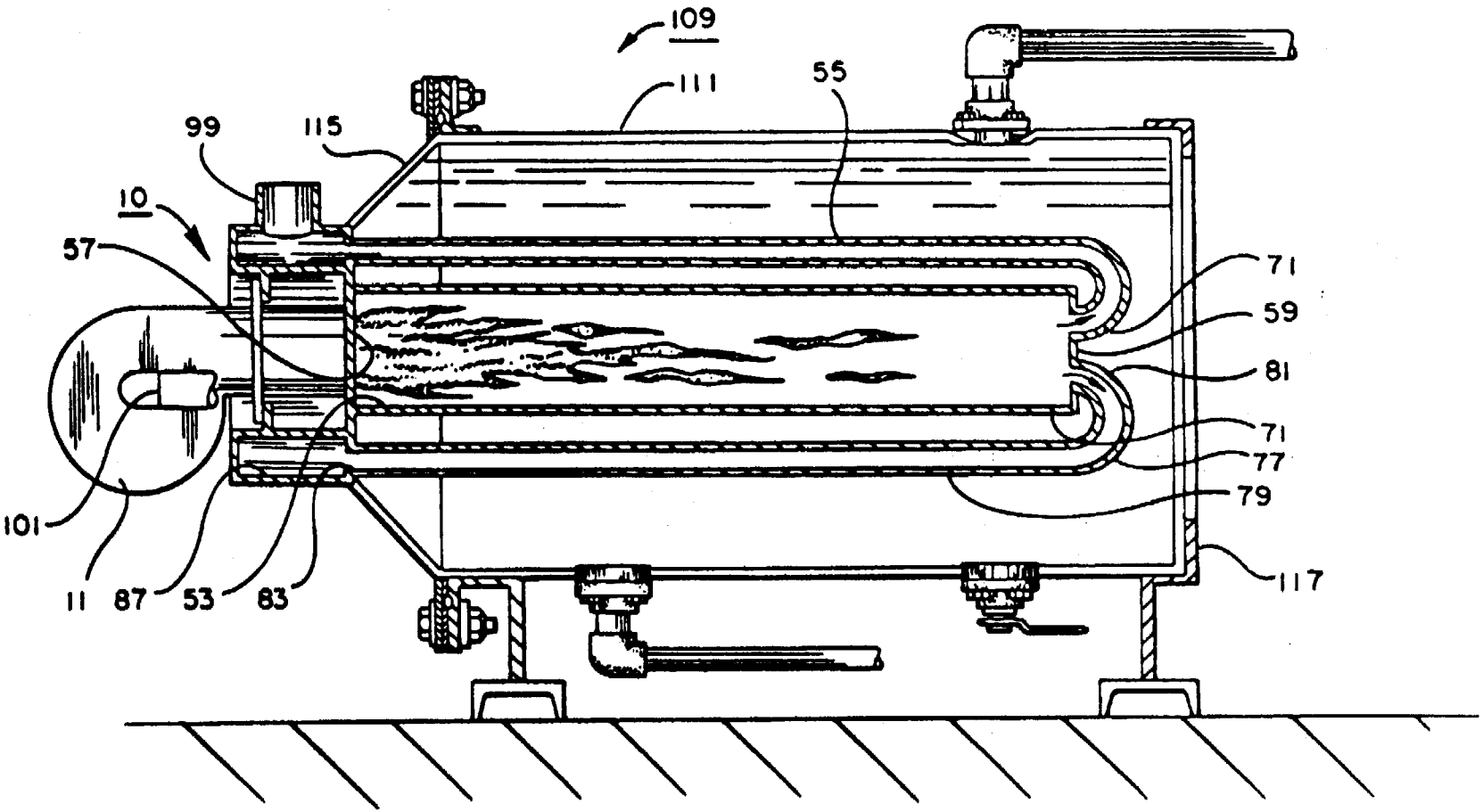
FIG. 4 is a cut-away, side view of a water heating apparatus of the invention.

FIGS. 1 and 3 show one embodiment of the water heating apparatus of the invention that decreases thermal $NO_x$ formation. The water heating apparatus has an air-fed, forced draft, burner 11; a submergible, pressurized, combustion chamber 51 mounted within a vertical closed tank 103; a flue collector 85 and a flue gas recirculation conduit 101. FIG. 4 shows another closed tank arrangement in which the tank extends generally horizontally rather than vertically.

In either arrangement, air feeds into an air intake shroud (13 in FIG. 1) of an air-fed, forced draft burner 11. The burner 11 can be fueled with propane, natural gas, or oil, but is preferably fueled by natural gas. The burner 11 has the capability to create an overfire pressure. A preferred forced draft burner should have approximately an 83% or greater fuel to water efficiency as measured using ANSI Z.21.10.3 standards. Flame temperatures for such burners range are in the range of about 1900 degrees F., or higher. By utilizing the flue gas recirculation techniques of the invention, the flame temperature is preferably maintained in the range from about 1600 to 1700 degrees F.

The air intake shroud (13 in FIG. 1) has an air intake opening 17 and a flue gas recirculation inlet 15. The air intake opening 17 communicates with the burner impeller housing 19 and a fuel/air mixing passage 25. The air intake opening can open directly to the local environment or connect to a fresh air conduit that supplies fresh air, such as a pipe or duct. The flue gas recirculation inlet 15 communicates by means of a flue gas recirculation conduit 101 with flue collector 85.

Figure 2A:
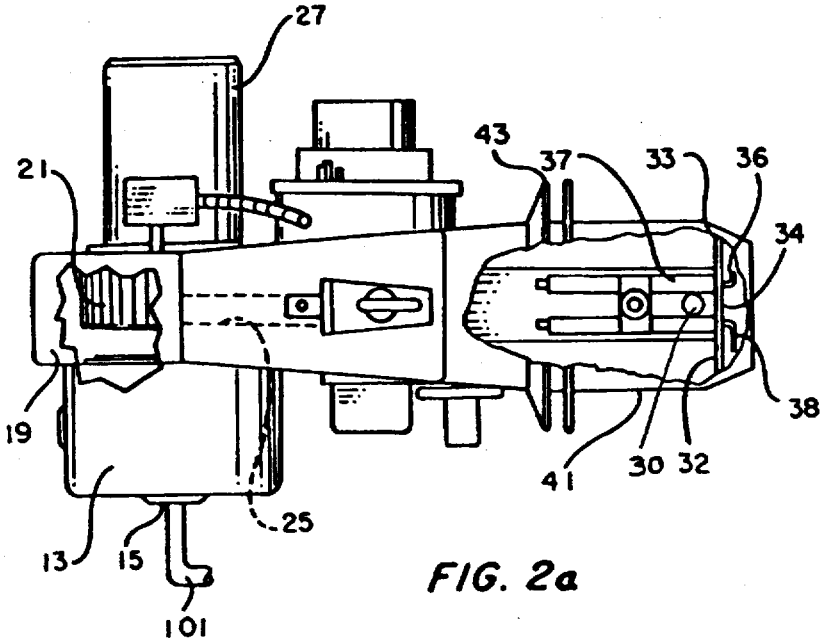
FIG. 2*a* is a cut-away elevational view of an air fed, forced draft burner used in the apparatus of FIG. 1.
Figure 2B:
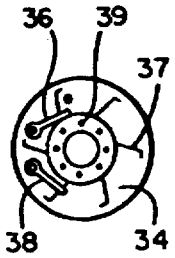
FIG. 2*b* is an isolated end view of the pressure plate of the burner of FIG. 2*a;*

The burner (11 in FIGS. 1 and 2*a*) includes an impeller housing 19 that contains a motor-driven impeller 21, driven by motor 27, which impels air from the air intake opening 17 into the fuel/air mixing passage 25. The fuel/air mixing passage 25 terminates at the first face 32 of a pressure plate 33. Pressure plate 33 also has a second, oppositely arranged face 34 (FIG. 2*b*) onto which is mounted an ignition means including electrodes 36, 38. A combustible fuel is supplied from a suitable source (not shown) to primary gas ports 30 located upstream of pressure plate 33 and to secondary gas ports 39 located on the opposite face 34 of the pressure plate. The pressure plate 33 has openings 37 to allow passage of the highly pressurized, air/fuel mixture from the fuel/air mixing passage 25.

Nozzle 41 directs the resulting flame from the burner 23 to the submerged combustion chamber 53. The nozzle 41 can be either a portion of the housing 19 or a separate piece that connects to the housing 19. The burner 45 can be attached to the tank 103 in any convenient manner, such as by circumferential ring 43 which is provided with a series of holes 45 that receive lugs 47 on partition 49 (FIG. 3) for bolting the nozzle 41 onto the flue collector 85. The hot combustion products from the burner 23 pass through the interior of submerged combustion chamber 53 and through fire tubes 55.

The submerged and pressurized combustion chamber 51 which is received within the tank opening (105 or 115) has cylindrical sidewalls 53 and has an opening at one end 57 and an opposite closed end 59.

The combustion chamber 51 can be mounted on the tank 103 at the outwardly extending collar 63 which fixedly connects to the tank exterior and circumscribes the tank opening 105, extending outwardly therefrom, generally normal to the sidewalls 107 of tank 103. The outwardly extending collar 63 is securely affixed to the tank 103 by welding or the like, or is an integral part of the tank body. The end area 61 has a plurality of threaded bores 65 suitably spaced and alignable with matching bores 69 in tube mounting flange 67, whereby a combustion chamber 51 can be bolted to the end area 61. In this way, the combustion chamber 51 is removed from the water tank 103 by detaching the tube mounting flange 67 and sliding the device out of the opening 105.

The combustion chamber 51 has a plurality of external heating surfaces, preferably curved fire tubes 55. At least part of the combustion chamber 53 and all of the heating surfaces are submerged in water under pressure during operation. Each fire tube 55 has an end 71 (FIG. 4) that communicates with the combustion chamber 53 through the closed end 59 and an opposite end 73 extending through the mounting flange 67. Each of the curved tubes 55 has a portion of its length generally U-shaped 77. The combustion chamber 53 extends at least partially the length of the curved fire tubes 55, thus creating a long leg 75 running along the exterior of the combustion chamber 53 and separated by the U-shaped portions 75 from a short leg 81 (FIG. 4) that joins and extends through the closed end 59. The length of the combustion chamber 53 can vary by shortening the length of the chamber, thereby increasing the length of leg 79 of tubes 55.

The ends 71 of curved tubes 55, as shown in FIGS. 3 and 4, preferably extend to communicate through mounting flange 67 by means of openings 83 with the tank exterior, when the device 51 is within the opening 105. The tube ends 73 are fixedly secured to flange 67. Although a small number of curved tubes 55 are shown, a greater number of tubes and openings can be used, if desired. Acceptable materials for constructing the curved tubes 55 include copper, 90–10 copper-nickel alloy, titanium, stainless steel, or steel.

As shown in FIG. 4, the impelled combustion products blast through the combustion chamber and finally into the annular chamber 87 of flue collector 85 for either passive recirculation and exhaustion. The flue collector 85 thus removes combustion products from the combustion chamber 53 and the curved fire tubes 55. The flue collector 85 has both a flue opening 89 that communicates with the combustion chamber 53 and an annular chamber 87 (FIG. 4) that surrounds the flue opening 89, while remaining separated from it. The annular chamber 87 connects with fire tubes 55, through openings 83 in flange 67. A circumferential lip 91 joins the base 93 of the annular chamber 87 and has a plurality of holes 95 alignable with bores 83 in flange 67 and threaded bores 65 in collar 63 to mount flue collector 85 on the exterior of the tank 103. Flue collector 85 has a flue gas recirculation outlet 97 and a flue exhaust outlet 99 for venting products of combustion to the atmosphere. The flue gas exhaust outlet 99 is typically connected to a vent for carrying away combustion products.

The flue gas recirculation outlet 97 passively channels a portion of the flue gas back to the burner 11. Flue gas enters flue gas recirculation conduit 101 through the outlet 97 and exits through a flue gas recirculation inlet 15 to the air intake shroud 13. The conduit 101 can connect either directly to the air intake shroud 13, or into an air intake conduit that feeds through the air intake opening 17 into the burner. The diameter of the conduit is determined by the burner capacity and the desired flame temperature of the burner.

The water heating device shown in FIG. 4 includes a closed tank 103, 109 having tubular sidewalls 107, 111, that may have a plurality of fittings, such as a cold water inlet, a hot water outlet and a pressure relief fitting. The tank can have a variety of configurations. For instance, the tank 13 can be either vertical or horizontal and made of a suitable material, such as steel. In FIG. 4, the tank 109 has an open interior 113, tubular sidewalls 111 and a pair of opposing ends 115, 117. In the embodiment shown, end 115 is initially open. In another embodiment (FIG. 3), the opposing ends 115, 117 are closed 105 and the additional opening is in the sidewalls 107. This additional tank opening receives the heating module.

The forced draft heating module 11, with the exception of the passive flue gas recirculation system, is described in detail in U.S. Pat. No. 4,465,024, assigned to the assignee of the present invention. Any additional disclosure from the '024 patent not expressly set forth above is incorporated herein by reference. The module is commercially available from PVI Industries, Inc., Fort Worth, Tex., as the TURBOPOWER module.

Figure 5:
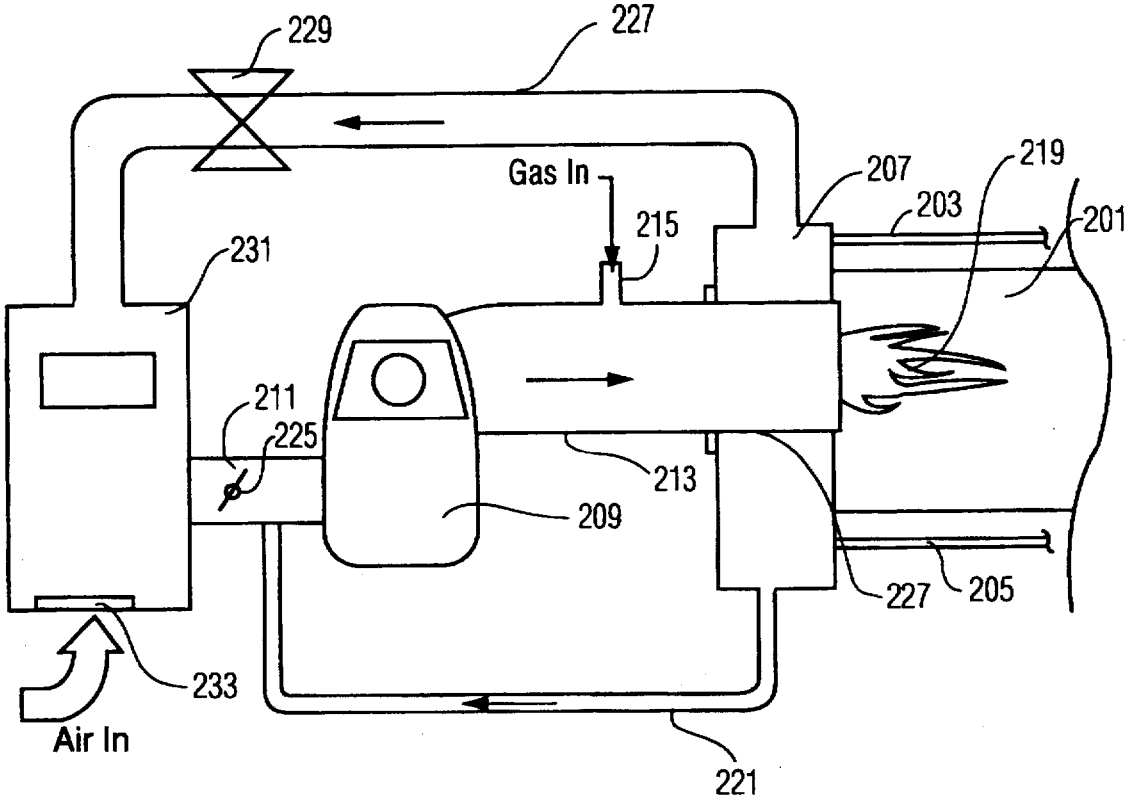
FIG. 5 is a schematic view illustrating another embodiment of the water heating apparatus of the invention.

FIG. 5 shows another embodiment of the apparatus of the invention in schematic fashion. The apparatus of FIG. 5 includes a normally submerged combustion chamber 201 having a plurality of curved fire tubes 203, 205 which communicate with a flue collector 207 in the manner previously described. In this case, a burner blower fan 209 impels air from an air intake passage 211 into a fuel/air mixing passage 213 to be mixed with fuel entering from a fuel inlet 215 prior to reaching the combustion region. In the manner previously described, the burner nozzle 217 directs the resulting flame 219 from the burner combustion region into the interior of the submerged combustion chamber 201.

In the embodiment of FIG. 5, a secondary passive flue gas recirculation conduit 221, in this case 2" in diameter, passively channels a portion of the flue gas from the flue collector 207 back to the air intake passage 211 to a point downstream of an intake damper 225. A primary passive flue gas recirculation conduit 227, in this case 6" in diameter, passively channels flue gas past a control valve 229 to an air intake box 231. The air intake box 231 has a fresh air inlet 233 and supplies fresh air and the recirculated flue gas products from conduit 227 to the air intake passage 211. The fresh air and flue gas products entering the passage 211 are also combined with the flue gas products entering the passageway from the secondary passive flue gas recirculation conduit 221 prior to being drawn into the blower fan 209 of the burner and being impelled down the fuel/air mixing passage 213. The firing condition of the burner would be used to signal the control valve 229.

The secondary recirculation loop 221 allows return gases to flow when the valve 229 is closed and when the fresh air supply to the air intake box is shut off or nearly off during modulated low fire or pilot operation of the burner.

The invention pairs a clean and efficient burning, submergible, pressurized, combustion system with a passive flue gas recirculation system. This combustion system burns with a cooler flame and thus produces fewer $NO_x$ emissions. The high efficiency combustion system also produces combustion products at lower temperatures. This particular gas fueled, combustion system without a flue gas recirculation system typically produces $NO_x$ emissions ranging from about 50 to about 60 ppm. Although these levels are low, they do not meet the current standards for various air quality regions. Therefore, a further reduction of the emissions is desired.

These cooler combustion products produced by this efficient system further decrease $NO_x$ emissions when the flue gases are passively recirculated. In the invention, flue gases and fresh air passively mix together before entering the burner inlet for combustion, without mixing directly at the burner and the introduction of fuel. Better mixing improves the decrease in $NO_x$ emissions by enhancing combustion and further diluting and cooling the flue gases. Adding the invention's passive flue gas recirculation system to the high efficiency heating module reduces $NO_x$ emissions from about 60 ppm to about 30 ppm with a gas burning, forced draft burner module, about a 50% reduction. These emission levels comply with the stringent $NO_x$ requirements of various air quality districts.

The passive flue gas recirculation system of the invention effectively reduces $NO_x$ emissions without interfering with the combustion efficiency of the heating module. The water heating apparatus of the invention reduces $NO_x$ emissions to an acceptable level while using the active components that are already incorporated into the heating system. The apparatus does not require the use of additional, active components.

While the invention is shown in only one of its forms, it is not thus limited but is susceptible to various changes and modifications without departing from the spirit and scope of the invention.

What is claimed is:

1. A water heating apparatus comprising:

a closed tank having an exterior, an interior and external walls having at least one opening therein;

a submerged, pressurized combustion chamber mounted within the tank opening by means of a mounting flange, the combustion chamber having multiple external heating surfaces which are submerged in water under pressure when the combustion chamber is mounted within the tank opening;

a flue collector mounted to the combustion chamber mounting flange on the tank exterior, the flue collector having a flue opening communicating with the combustion chamber and having an annular chamber surrounding the flue opening and separated therefrom which receives the products of combustion produced within the combustion chamber, the annular chamber having a flue exhaust outlet and a flue gas recirculation outlet;

an air-fed, forced draft burner having an air intake region for the intake of fresh air, a fuel/air mixing passage leading to a combustion region, a motor-driven impeller for forcing air from the intake region in the direction of the combustion region and a burner nozzle, the burner nozzle being mounted within the flue opening of the flue collector for producing controlled combustion within the combustion chamber;

an air intake box having a fresh air inlet, the air intake box being connected by means of an air intake passage with the air intake region of the forced draft burner;

a primary flue gas recirculation conduit passively connecting the flue gas recirculation outlet with the air intake region of the burner upstream of the combustion region and burner nozzle, whereby fresh air and recirculated flue gas are mixed in the air intake region of the burner prior to entering the combustion region and burner nozzle; and a secondary flue gas recirculation conduit connecting the flue gas recirculation outlet with the air intake box for providing recirculated flue gas to the forced draft burner during periods of low burner fire or pilot operations.

2. The water heating apparatus of claim 1, wherein the secondary passive flue gas recirculation conduit includes a control valve for controlling the flow of recirculated flue gases dependent upon the burner demand.

3. The water heating apparatus of claim 2, wherein the air intake passage includes an intake damper and wherein the primary flue gas recirculation conduit enters the air intake passage downstream of the intake damper.

4. The water heating apparatus of claim 3, wherein the fresh air from the air intake box and the combined recirculated flue gas from the secondary passive flue gas recirculation conduit enter the air intake passage upstream of the intake damper.

* * * * *